US006965088B2

(12) United States Patent
Franklin et al.

(10) Patent No.: US 6,965,088 B2
(45) Date of Patent: Nov. 15, 2005

(54) INTERRUPTING APPARATUS HAVING OPERATIONS COUNTER AND METHODS OF FORMING AND USING SAME

(75) Inventors: David A. Franklin, Morgantown, NC (US); Eugene H. Wood, Hickory, NC (US); Michael G. Nolte, Hickory, NC (US)

(73) Assignee: Utility Solutions, Inc., Hickory, NC (US)

( * ) Notice: Subject to any disclaimer, the term of this patent is extended or adjusted under 35 U.S.C. 154(b) by 0 days.

(21) Appl. No.: 10/734,468

(22) Filed: Dec. 12, 2003

(65) Prior Publication Data

US 2005/0127040 A1 Jun. 16, 2005

(51) Int. Cl.[7] ..... H01H 9/30
(52) U.S. Cl. ..... 218/14; 218/12; 218/1
(58) Field of Search ..... 218/1, 7, 12, 14, 218/43–47, 51–54, 59, 78, 84, 92, 153–155; 200/17 R, 50.1

(56) References Cited

U.S. PATENT DOCUMENTS 2,816,980 A * 12/1957 Lindell ..... 218/12
2,816,984 A 12/1957 Lindell
2,816,985 A 12/1957 Lindell
3,727,019 A * 4/1973 Harvey ..... 218/140
3,958,156 A * 5/1976 Tjebben ..... 218/119
4,277,677 A 7/1981 Neher
5,502,427 A * 3/1996 Scherer et al. ..... 337/176
5,650,602 A 7/1997 Wood et al.
5,861,595 A 1/1999 Wood et al.
6,300,585 B1 10/2001 Nicolai

* cited by examiner

*Primary Examiner*—Elvin G. Enad
*Assistant Examiner*—M. Fishman
(74) *Attorney, Agent, or Firm*—Bracewell & Giuliani LLP

(57) ABSTRACT

A portable circuit interrupting apparatus for use on a circuit isolating device and associated methods of formation and use are provided. The portable circuit interrupting apparatus includes a main housing body and a sleeve coaxially mounted therein. The sleeve is slidable between an extended and retracted position. A shunt circuit segment is connected between ring and hook engaging terminals which engage and form an electrical connection between ring-like and hook-like conducting parts of the circuit isolating device. A shunt circuit segment interrupts the electrical connection in response to movement of the sleeve from the retracted position to the extended position. At least portions of a reset plunger extend inwardly through an opening in a medial portion of the sleeve when in the extended position. An operation counter is connected to and responds to the inward extension of the reset plunger to count a number of circuit interrupting operations.

30 Claims, 7 Drawing Sheets

35
32
36
37
68
71
70
25
50
54
40
48
44
20
56
33
60
$F_1$
64
77
58
34
42
62
74
SHUNT INTERRUPTING CIRCUIT
$F_2$
45
38
63

INTERRUPTING APPARATUS HAVING OPERATIONS COUNTER AND METHODS OF FORMING AND USING SAME

BACKGROUND OF THE INVENTION

1. Field of the Invention

The present invention relates to a circuit interrupting apparatus and, more particularly, to a circuit interrupting apparatus for medium- and high-voltage circuit isolating devices having operations counters and methods of forming and using such circuit interrupting apparatus associated therewith.

2. Description of the Related Art

Circuit isolating devices such as fuse cutouts, disconnecting switches, and power fuses are adapted to be periodically opened to provide necessary service, such as for fuse replacement or service to power lines. Conventionally, such circuit isolating devices include a ring-like conducting part and a hook-like conducting part which are relatively movable between a contacting position to establish a closed circuit through the device and a separated position to establish an open circuit through the device.

When it is necessary to open the circuit isolating device when it is carrying load current, an arc is drawn between the two conducting parts, which is likely to damage any components which are contacted by the arc. Also, where other adjacent circuits are involved, there is a risk that the drawn arc may jump to another circuit, causing a fault in the other circuit. Still further, there is a risk that the drawn arc can jump an operator, causing some type of injury.

To minimize the risks and dangers associated with the opening of such circuit isolating devices, a specially designed portable circuit interrupting apparatus has been developed as described, for example, in U.S. Pat. No. 2,816,984 by Lindell titled "Circuit Interrupter Construction" and in U.S. Pat. No. 2,816,985 by Lindell titled "Circuit Interrupting Means." This apparatus typically comprises a rod-like terminal which enters the ring-like conducting part of the isolating device and a second terminal which loops about the hook-like conducting part. The interrupting apparatus is mounted at the upper end of an elongated line pole.

In use, the operator initially lifts the apparatus to an elevated position adjacent the isolating device while holding the lower or proximal end of the line pole, and the operator then swings the interrupting apparatus into engagement with the isolating device so as to bring the two terminals of the interrupting apparatus into proper contact with the two conducting parts of the isolating device. The interrupting apparatus of the type described above, and as illustrated and described in the above-referenced patents, should be carefully manipulated during its initial engagement with the isolating device so that the two terminals properly engage the two conducting parts of the isolating device. This typically requires the hook engaging terminal of the interrupting apparatus to initially engage the hook-like conducting part of the isolating device. The interrupting apparatus is then swung laterally so that the ring engaging terminal of the interrupting apparatus enters the ring-like conducting part of the isolating device.

Upon then pulling downwardly on the line pole, the operator is able to separate the two conducting parts of the isolating device to open the circuit so that the current then flows through a shunt circuit which is located in the interior of the interrupting apparatus. The interrupting apparatus further has a shunt circuit interrupter which opens the shunt circuit inside the apparatus so that the resulting arc is confined to the interior of the apparatus. Next, the interrupting apparatus is disconnected from the two conducting parts of the isolating device. A resetting latch is then engaged to allow the interrupting apparatus to be reset for the next use.

Often it is desirable to keep track of the number of interrupting apparatus operations, and thus the number of circuit isolating devices serviced, in order to analyze operator productivity or to facilitate maintenance based on the number of operations rather than length of time the interrupting apparatus is in the field. It is, however, difficult to accurately keep track of the number of operations performed by each interrupting apparatus. It has been recognized that an operation counter can be used to count the number of operations. For example, U.S. Pat. No. 6,300,585, by Nicolai titled "Operation Counter for a Circuit Interrupter," describes an operation counter used to count the number of operations of a circuit interrupter in order to determine the operating life of the circuit interrupter and to determine a maintenance schedule to be applied to the circuit interrupter. The operation counter is responsive to contact with an arc-suppressing member and is positioned on or within an exhaust control portion of a circuit interrupter. Applicants have recognized that counters such as that described, however, are prone to excessive wear because part of the counter mechanism is in contact with arc-interrupting components or shunt-interrupting circuits which are subject to the wear and tear or other forms of degradation caused by arcing resulting from the circuit interrupting operation. Applicants therefore also recognized a need for an interrupting apparatus which can count the number of operations performed by each circuit interrupting apparatus that does not require direct interface with shunt-interrupting circuit components. Additionally, there are many circuit interrupting apparatus deployed in the field which do not have an operation counter. Applicants also further recognized a need for an operation counter that can be easily and inexpensively retrofitted to existing circuit interrupting apparatus to provide a count of the number of operations performed by the operator on an isolating circuit device.

Additionally, though such counters can be used to show a possible representation of the wear and tear on the circuit interrupting apparatus, such counters record operations regardless of the amperage of the circuit being interrupted. Though operator productivity is not a function of the amperage of the circuits repaired by the operator and a rough representation of component fatigue can be deduced from a raw count of the number of operations, high amperage operations cause much more wear and erosion than medium amperage operations which cause more wear and erosion than low amperage operations. Applicants still further recognized a need for a counter that can record total operation counts along with operation counts related to various categories of amperage interrupted by the interrupting apparatus to be used to formulate a maintenance or inspection schedule.

SUMMARY OF THE INVENTION

In view of the foregoing, embodiments of the present invention advantageously provide an apparatus and methods related to formation and use of a circuit interrupting apparatus that provide the user the ability to count the number of circuit interruption events performed on circuit isolating devices. Advantageously, embodiments of the present invention also provide a circuit interrupting apparatus which includes a counter that can count the number of operations performed by each circuit interrupting apparatus that does not require direct interface with shunt interrupting circuit components. Advantageously, embodiments of the present invention also provides a counter and methods that can record total operation counts along with operation counts related to various categories of amperage interrupted by a circuit interrupting apparatus. Advantageously, an embodiment of the present invention provides an operation counter that can be easily and inexpensively retrofitted to existing circuit interrupting apparatus.

More particularly, an embodiment of the present invention provides a portable circuit interrupting apparatus which includes a main housing having a main housing body including a main housing body outer surface and a longitudinal axis. A sleeve having a sleeve main body including a sleeve main body outer surface is coaxially mounted within the main housing so as to be slidable between an extended position and a retracted position. A spring assembly biases the sleeve main body from between the extended position toward the retracted position such that unless pinned or otherwise held extended, the sleeve main body will retract.

The portable circuit interrupting apparatus also includes a shunting circuit assembly having a ring engaging terminal adapted to electrically connect to a ring-like conducting part of a circuit isolating device and a hook engaging terminal adapted to electrically connect to a hook-like conducting part of a circuit isolating device. A shunting circuit segment is connected between the ring engaging terminal and the hook engaging terminal and is positioned within the housing and sleeve to interrupt the electrical connection between the ring-like conducting part and hook-like conducting part in response to movement of the sleeve from the retracted position to the extended position. This hollows the arc caused by the circuit interruption to be maintained within the circuit interrupting apparatus.

The portable circuit interrupting apparatus also includes a reset plunger assembly, which includes a reset plunger, connected to a medial portion of the main housing body. The reset plunger is adapted to have at least portions thereof extend through a reset plunger opening positioned in the medial portion of the main sleeve body when in a non-reset and biased inward lock position to releasably lock the sleeve in the extended position. This allows the interrupting apparatus to obtain and maintain an electrical clearance between the ring engaging terminal and the hook engaging terminal when the ring engaging terminal and the hook engaging terminal engage a circuit isolating device and when the main sleeve body is positioned in the extended position. The reset plunger is also adapted to reset outwardly in response to outwardly biased pressure by a user and outward pressure from the main sleeve outer surface when the sleeve main body is in an at least partially retracted position.

The portable circuit interrupting apparatus further includes an operation counter assembly having an operation counter connected to the reset plunger and positioned to count a number of circuit interrupting operations of the circuit interrupting apparatus in response to movement of the reset plunger. The operation counter assembly can be manufactured with the circuit interrupting apparatus or retrofit to a pre-existing circuit apparatus. The operation counter can include a rotational counter incrementor to increment a count of the operation counter. A roll pin or other connection device can be connected to the reset plunger in order to engage a click-over lever. The click-over lever is situated between the rotational counter incrementor and the roll pin and can be either permanently or intermittently connected. The click-over lever can respond to longitudinal movement of the reset plunger in a first direction to reset the counter to enable the operation counter to increment and responds to longitudinal movement in a second direction to increment the operation counter when such movement occurs.

The operation counter assembly can also include a selection switch for selecting a plurality of categories of amperage range of values most closely associated with the circuit isolating device. The operation counter can separately record the operation count and associate the operation count with a category selected from the plurality of categories and can track a number of counts associated with each of the plurality of categories and display the number of counts associated with the category so selected. This provides the user the ability to develop maintenance schedules based on actual usage in both quantity and quality.

The present invention also includes methods of forming and using a circuit interrupting apparatus adapted to count a number of circuit interrupting operations. For example, according to an embodiment of the present invention, a method of forming the circuit interrupting apparatus includes providing an operation counter assembly having an operation counter housing containing an operation counter and an operation counter actuating switch. The operation counter housing has a housing back side opening adapted to interface with a reset plunger protruding through a main housing body outer surface of the circuit interrupting apparatus and an operation counter housing front side opening to allow passage of the reset plunger through the operation counter housing. The method also includes installing an operation counter actuating switch actuator to the reset plunger, and fastening the operation counter housing to the main housing body of the circuit interrupting apparatus.

According to an embodiment of the present invention, a method of using the circuit interrupting apparatus on a circuit isolating device includes positioning a reset plunger to extend through a reset plunger opening in a medial portion of a main sleeve body positioned within a main housing body of the circuit interrupting apparatus when the main sleeve body is positioned in an extended position. The method can also include engaging a hook-like conducting part of the circuit isolating device with a hook engaging terminal of the circuit interrupting apparatus adapted to electrically connect to the hook-like conducting part, and engaging a ring-like conducting part of the circuit isolating device with a ring engaging terminal of the circuit interrupting apparatus adapted to electrically connect to the ring-like conducting part of the circuit isolating device. The ring-like conducting part is relatively moveable between a contacting position to establish a closed circuit through the circuit isolating device and a separated position to establish an open circuit through the circuit isolating device and to extend the main sleeve body from within the main housing body of the circuit interrupting apparatus. Opening the circuit with the circuit interrupting apparatus provides the impetus for rerouting the current through the circuit interrupting apparatus. The method can further include extending at least portions of the reset plunger through the reset plunger opening in the medial portion of the main sleeve body in response to the positioning of the main sleeve body in the extended position, and incrementing an operation counter connected to the main body housing of the circuit interrupting apparatus upon and in response to extension of the at least portions of the reset plunger through the medial portion of the main sleeve body.

A circuit interrupting apparatus according to an embodiment of the present invention advantageously can be used for keeping track of the number of circuit interrupting operations of and thus the number of circuit isolating devices serviced. This can help facilitate maintenance based on the number of raw operations or an itemized account of operations based on the amperage interrupted rather than length of time the interrupting apparatus is in the field. Advantageously, in an embodiment of the present invention the operations counter is not exposed to exhaust gases during use and, due to the positioning, can be housed in a durable metal housing to improve durability and lessen the chance of damage to the counter. Advantageously, in embodiments of the present invention, an operations counter cannot be reset to provide for a continuous monitoring of the operations performed throughout the life of the interrupting apparatus. Advantageously, in embodiments of the present invention, an operations counter can be positioned to count each time the tool is reset; thus, it never comes in contact with any internal loadbreak mechanisms.

BRIEF DESCRIPTION OF THE DRAWINGS

So that the manner in which the features, advantages and objects of the invention, as well as others which will become apparent are attained and can be understood in more detail, a more particular description of the invention briefly summarized above may be had by reference to the embodiment thereof which is illustrated in the appended drawings, which drawings form a part of this specification. It is to be noted, however, that the drawings illustrate only a preferred embodiment of the invention and is therefore not to be considered limiting of its scope as the invention may admit to other equally effective embodiments.

DETAILED DESCRIPTION

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and the prime notation, if used, indicates similar elements in alternative embodiments.

As illustrated in FIGS. 1–8, embodiments of the present invention advantageously provide a portable circuit interrupting apparatus 32 for use in association with a utility powerline circuit isolating device to expeditiously open the circuit, typically medium and high-voltage isolating device 10 while it is carrying line current. The circuit interrupting apparatus 32 is adapted to be held in the hand of a user and has an operation counter 91 to provide the user a continuous update of the number of circuit interrupting operations performed by the circuit interrupting apparatus 32. The operator initially lifts the circuit interrupting apparatus 32 to an elevated position adjacent the isolating device 10 while holding the lower end of the line pole, and the operator then swings the circuit interrupting apparatus 32 into engagement with the isolating device 10 so as to bring the two terminals of the circuit interrupting apparatus 32 into proper contact with the two conducting parts of the isolating device 10. The hook engaging terminal of the circuit interrupting apparatus 32 engages the hook-like conducting part of the isolating device 10. The circuit interrupting apparatus 32 is then swung laterally so that the ring engaging terminal of the circuit interrupting apparatus 32 enters the ring-like conducting part of the isolating device 10. Upon then pulling downwardly on the line pole, the operator is able to separate the two conducting parts of the isolating device 10 to open the circuit so that the current then flows through a shunt circuit which is located in the interior of the circuit interrupting apparatus 32. In response to an extension of a sleeve within the main body of the circuit interrupting apparatus 32, the operations counter 91 is automatically incremented.

Figure 1:
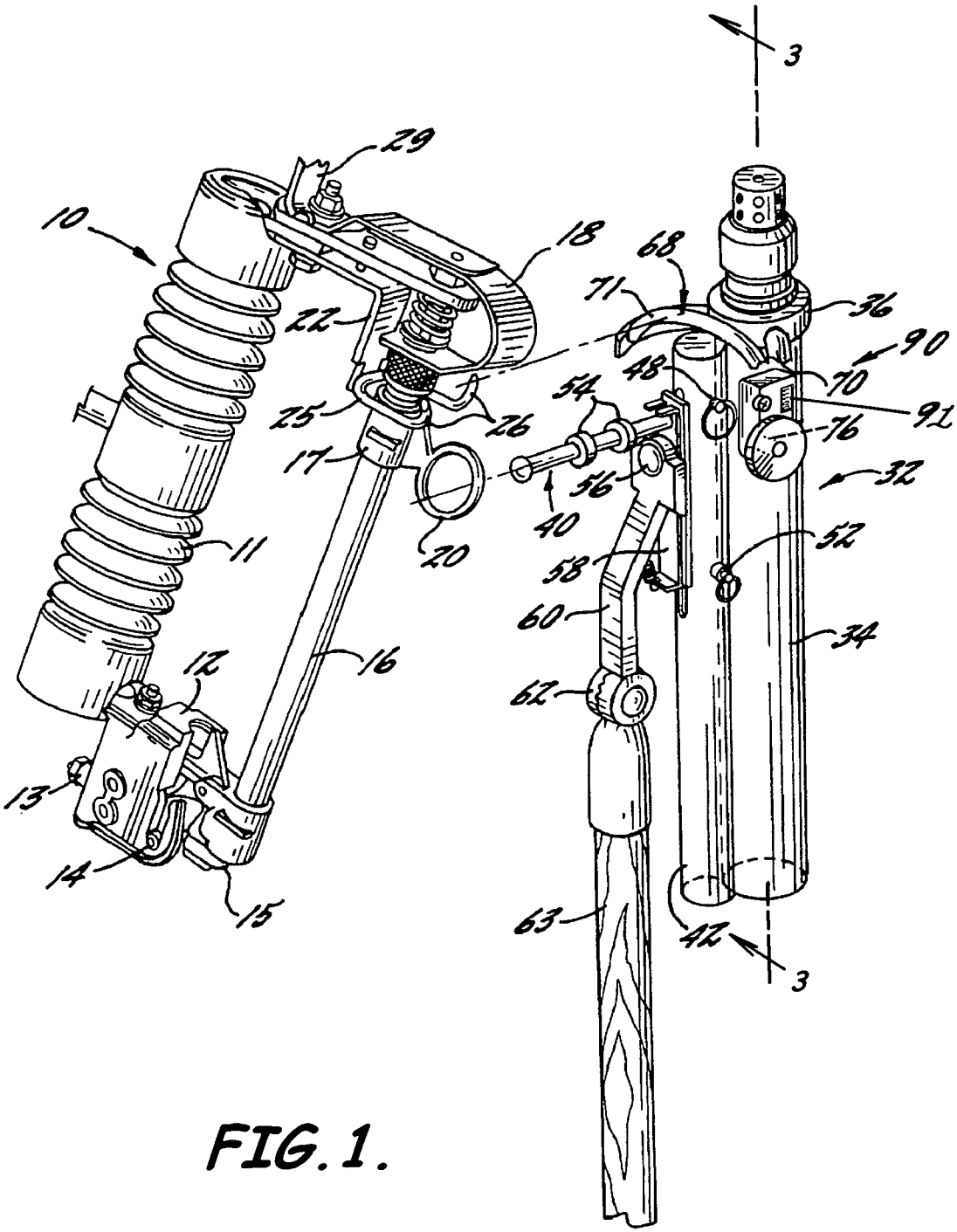
FIG. 1 is a perspective view of a circuit isolating device and a circuit interrupting apparatus of the present invention illustrating an initial portion of a step of positioning the circuit interrupting apparatus adjacent the isolating device according to an embodiment of the present invention.
Figure 2:
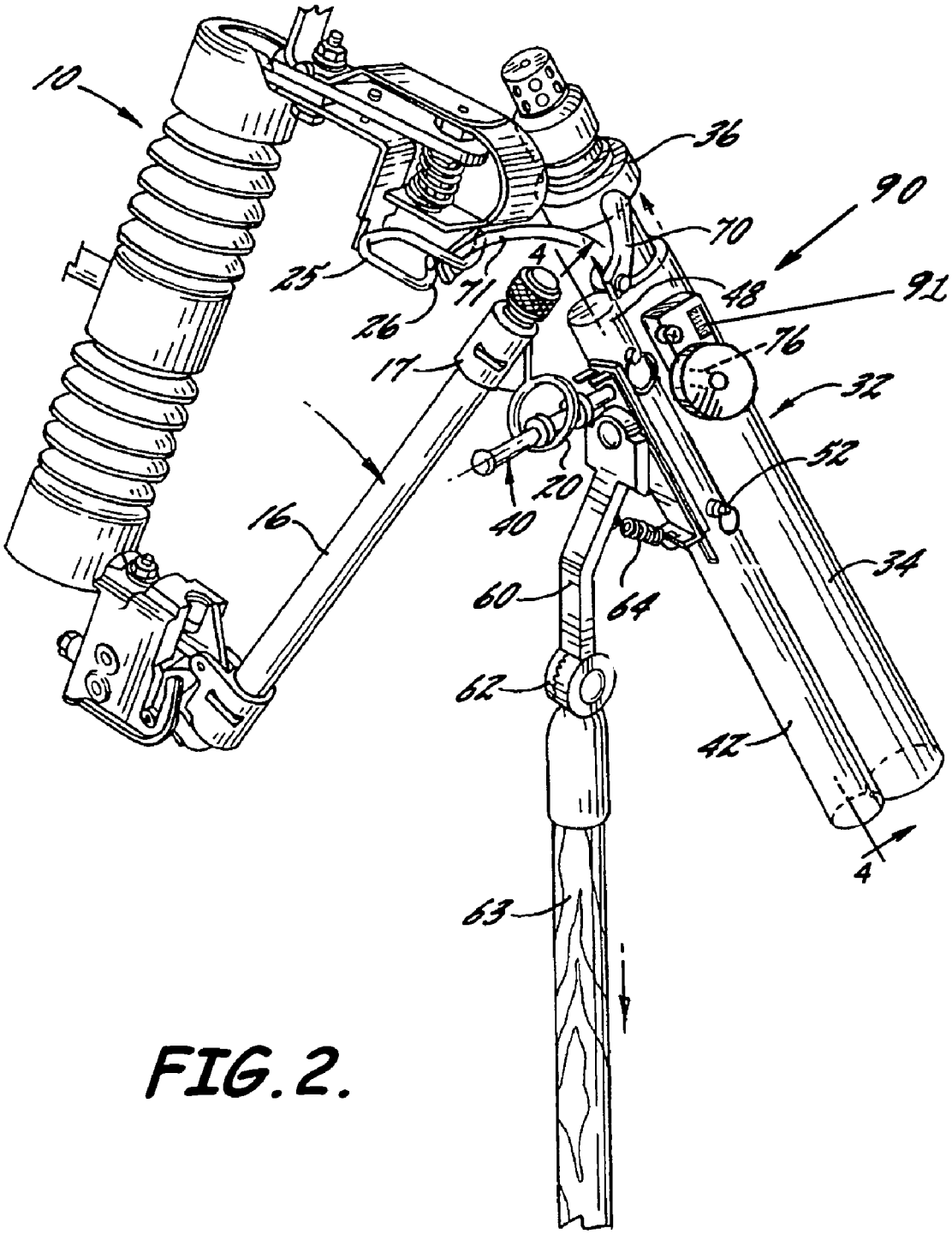
FIG. 2 is a view similar to FIG. 1 illustrating a circuit interrupting apparatus engaging the circuit isolating device and with the circuit isolating device having been moved to an open position, according to an embodiment of the present invention.

Note, a circuit isolating device 10 of the disconnecting fuse type is indicated in FIGS. 1–2 for illustrative purposes only. The circuit isolating device 10 is conventional as will be understood by those skilled in the art, and an example of the details of its construction are more fully set forth in U.S. Pat. No. 2,745,923 by Lindell, titled "Fuse Construction," the disclosure of which is expressly incorporated herein by reference. Note also, the circuit interrupting apparatus 32 having operation counter assembly is an improvement upon a circuit interrupting apparatus described in U.S. Pat. No. 5,861,595, by Wood et al. titled "Circuit Interrupting Apparatus and Method for High Current Powerlines," also incorporated herein by reference. Other circuit interrupting apparatus can, however, be retrofitted to include the operations counter 91 of embodiments of the present invention as will be understood by those skilled in the art.

In more specific detail, as shown in FIGS. 1–2, the circuit insulating device 10 typically includes an insulator 11 which is arranged to be stationary mounted on a cross arm or the like and has a lower terminal contact member 12 carrying a connector 13 for connection to a line terminal. Pivoted at 14 on the lower terminal contact member is a lower current carrying member 15 that is positioned at the lower end of a fuse tube 16. At its upper end, the fuse tube 16 has an upper current carrying member 17 which is positioned in contact engagement with a normally energized contact member 18 carried by the upper end of the insulator 11. In order to remove the upper current carrying member 17 from contact engagement with the terminal contact member 18, the former is provided with a ring-like conducting part 20. The terminal contact member 18 includes an L-shaped reinforcing bar 22 having a downwardly extending arm which carries a hook-like conducting part 25. The part 25 is shaped, in part, for guiding the upper current carrying member 17 into proper contact engagement with the terminal contact member 18. The part 25 includes forwardly extending arms 26 at the outer ends of which are transversely extending horns or studs. Provisions are also made for connecting an energized line conductor (not shown) to the terminal contact 18 and the bar 22 through a terminal pad 29.

Figure 3:
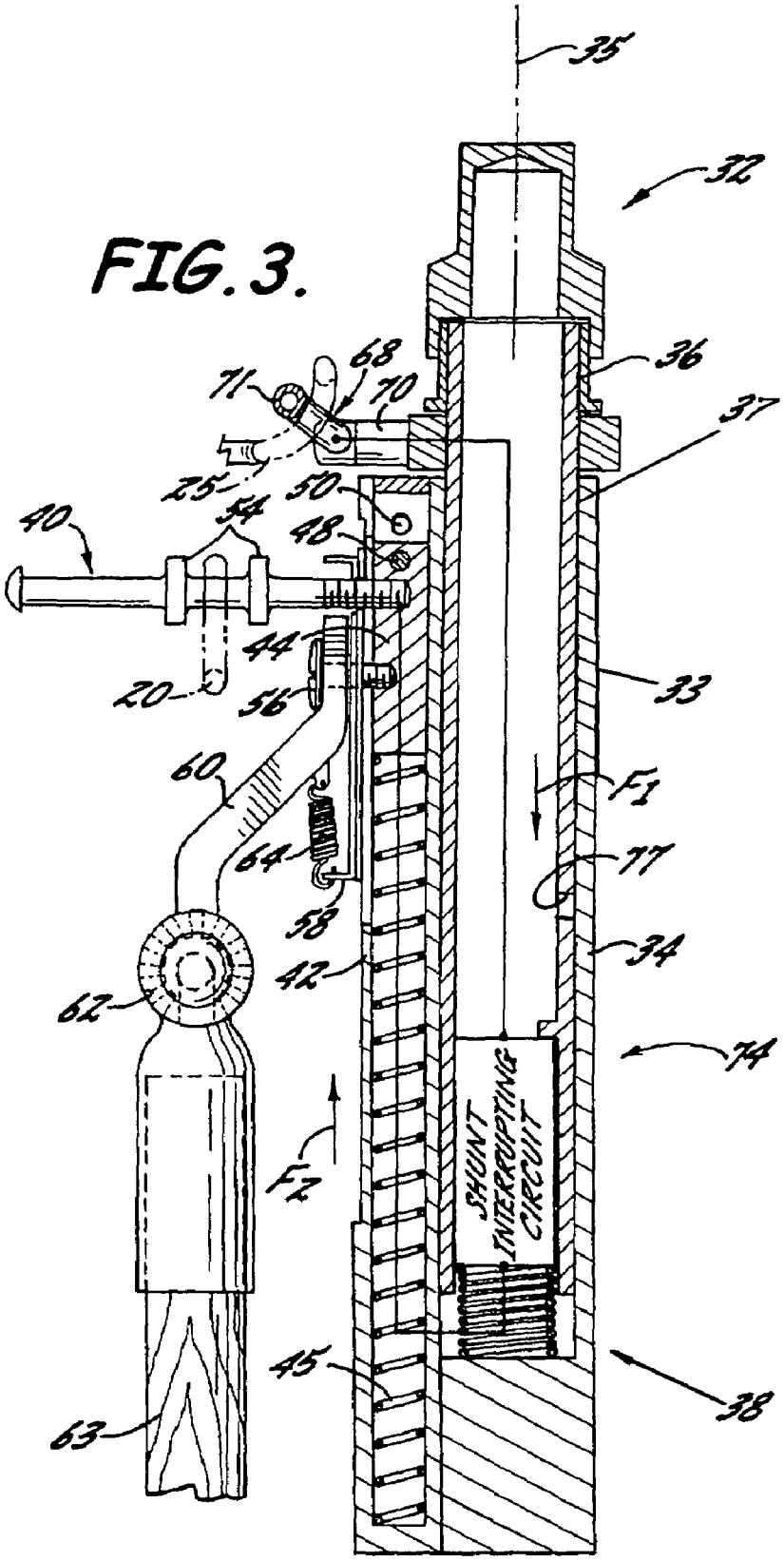
FIG. 3 is a fragmentary cross-sectional view of a circuit interrupting apparatus taken along the 3—3 line of FIG. 1 according to an embodiment of the present invention.

According to an embodiment of the present invention, as perhaps best shown in FIGS. 1–4, provided is a portable circuit interrupting apparatus 32 which includes a tubular main housing 34 having a main body including a main body outer surface 33 and a longitudinal axis 35. The circuit interrupting apparatus 32 also includes a sleeve 36 which includes a main body having a main body outer surface 37 and that is coaxially mounted within the main housing 34 so as to be slidable between an extended position (FIGS. 2 and 4) and a retracted position (FIGS. 1 and 3). The sleeve 36 includes a spring assembly including spring 38 for biasing the main body of sleeve 36 from between the extended position toward the retracted position. The main body of sleeve 36 further includes a reset plunger opening 77 positioned in a medial portion thereof.

Figure 4:
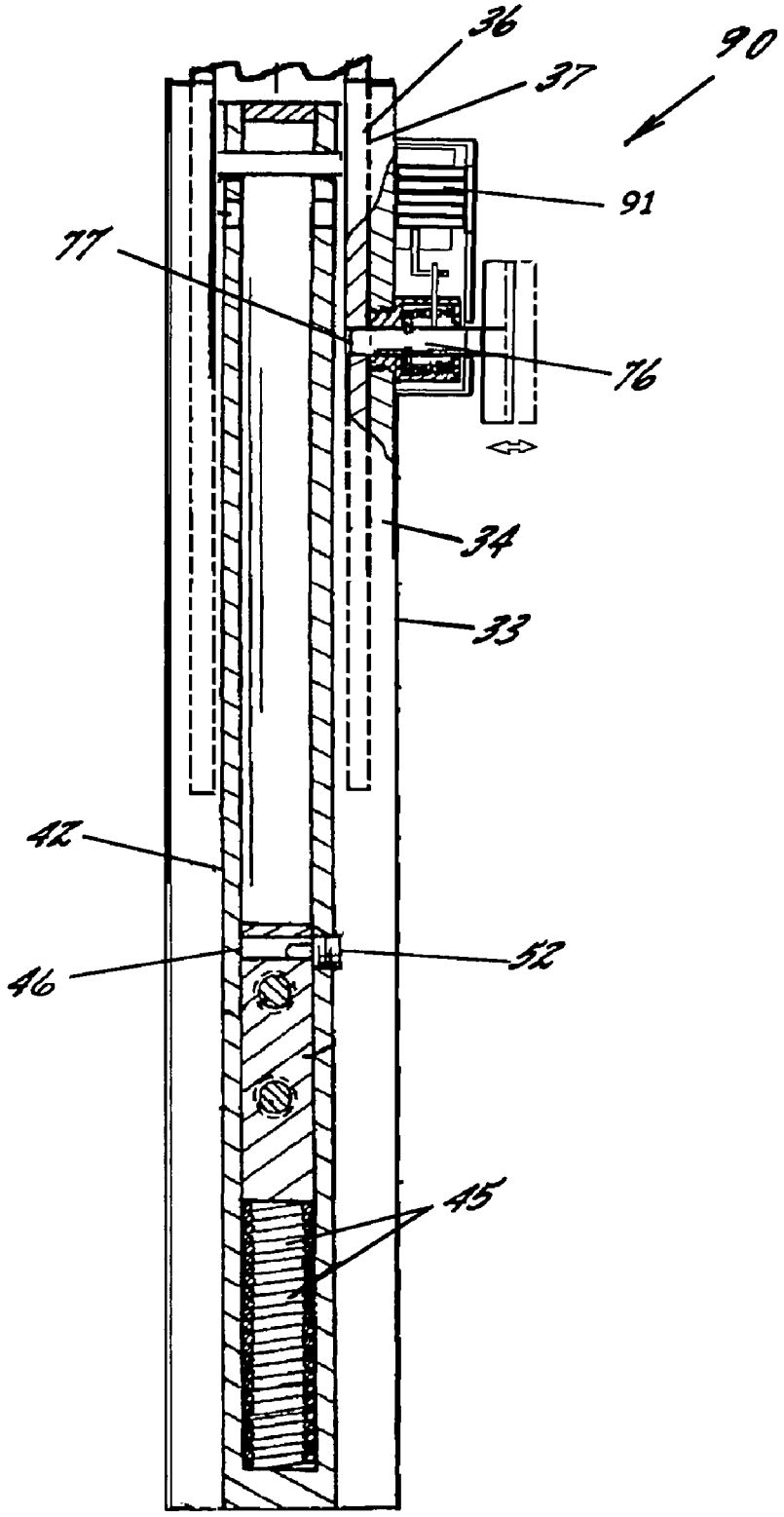
FIG. 4 is a fragmentary cross sectional view of a circuit interrupting apparatus taken along the 4—4 line of FIG. 2 according to an embodiment of the present invention.

A tubular cylinder 42 can be mounted to the exterior wall of the tubular housing 34, so as to be parallel to the longitudinal axis 35. The tubular cylinder 42 can, in turn, slidably mount a shuttle 44 in the interior thereof. As shown in FIG. 3, a spring 45 is positioned below the shuttle so as to bias the shuttle upwardly in the direction F2. The shuttle 44 is movable between two fixed positions, an upper position (FIG. 3) and a lower position (FIG. 4). As shown in FIG. 4, to be able to lock the shuttle in each of these positions, the shuttle 44 is provided with an opening 46 therethrough, and matching transverse openings 47 are provided in the wall of the tubular cylinder 42. Also, a transverse pin 48 is removably mounted to extend through the transverse openings 47 and the opening 46 of the shuttle 44 so as to releasably lock the shuttle 44 in the upper position, illustrated in FIG. 3. To move the shuttle 44 to its second or lower position, the pin 48 is withdrawn and placed at a storage location defined by a second pair of transverse openings 50 through the tubular cylinder 42. The shuttle 44 can then be moved downwardly by the user to the second position, against the force of the spring 45. In this configuration, as perhaps best shown in FIG. 4, release pin 52 automatically engages the opening 46 of the shuttle 44.

A ring engaging terminal 40 is mounted to the main housing 34 preferably in the manner as perhaps best shown in FIG. 3. The ring engaging terminal 40 takes the form of an elongate rod-like member which is essentially linear and includes a pair of axially spaced apart discs 54 at a medial location along its length. The terminal 40 thus defines a terminal axis. The terminal 40 is preferably threadedly mounted to shuttle 44 so that its terminal axis preferably at all times substantially perpendicularly intersects the longitudinal axis 35 of the main housing 34, even when the shuttle 44 moves between its upper and lower positions, if so configured to do so. In this regard, the terminal 40 extends outwardly through a vertical slot in the wall of the tubular cylinder 42, which precludes rotation of the shuttle 44 about the axis of the tubular cylinder 42. Also, although other connection methodologies of terminal 40 to housing 34 are within the scope of the present invention, the threaded connection is preferred to either the shuttle 44 or alternatively directly to the main body of housing 34 if the circuit interrupting apparatus 32 is not so configured, as it allows terminal 40 to be easily removed and replaced with a terminal having a different length or configuration, so as to best engage the particular isolating device 10 being serviced.

In an embodiment of the present invention, the shuttle 44 also mounts a pivot pin 56 which extends parallel to and below the terminal 40. The pivot pin 56 extends through a plate 58 and pivotally supports a line pole connector arm 60. The connector arm 60 includes a mounting post 62 by which a line pole 63 can be fixed thereto. A spring 64 can be interconnected between the connector arm 60 and the plate 58, so as to limit the pivotal movement of the connector arm 60 about the axis of the pivot pin 56, and return the arm to a neutral position.

As shown in FIGS. 1–3, the circuit interrupting apparatus 32 also includes a hook engaging terminal 68 in the form of a closed ring-like member or eye, which is mounted to the sleeve 36. The terminal 68 is preferably composed of a pair of rigid arms 70 extending outwardly from the sleeve 36 and an outer arcuate portion 71 which is mounted for pivotal movement between the rigid arms and for pivotal movement about an axis which can be substantially perpendicular to but spaced from the longitudinal axis 35 of the main housing 34.

As perhaps best shown in FIG. 3, the circuit interrupting apparatus 32 further includes a shunting circuit assembly 74 connected between the ring engaging terminal 40 and the hook engaging terminal 68 as illustrated schematically. The shunting circuit assembly 74 includes a circuit segment positioned within the main housing 34 and sleeve 36 that is positioned to interrupt the circuit segment responsive to the sleeve 36 being moved to and reaching its extended position. The shunting circuit assembly 74 is well known to those skilled in the art. For example, a preferred shunt circuit assembly is described in U.S. Pat. Nos. 2,816,984 and 2,816,985, the disclosures of which are expressly incorporated herein by reference.

Figure 5:
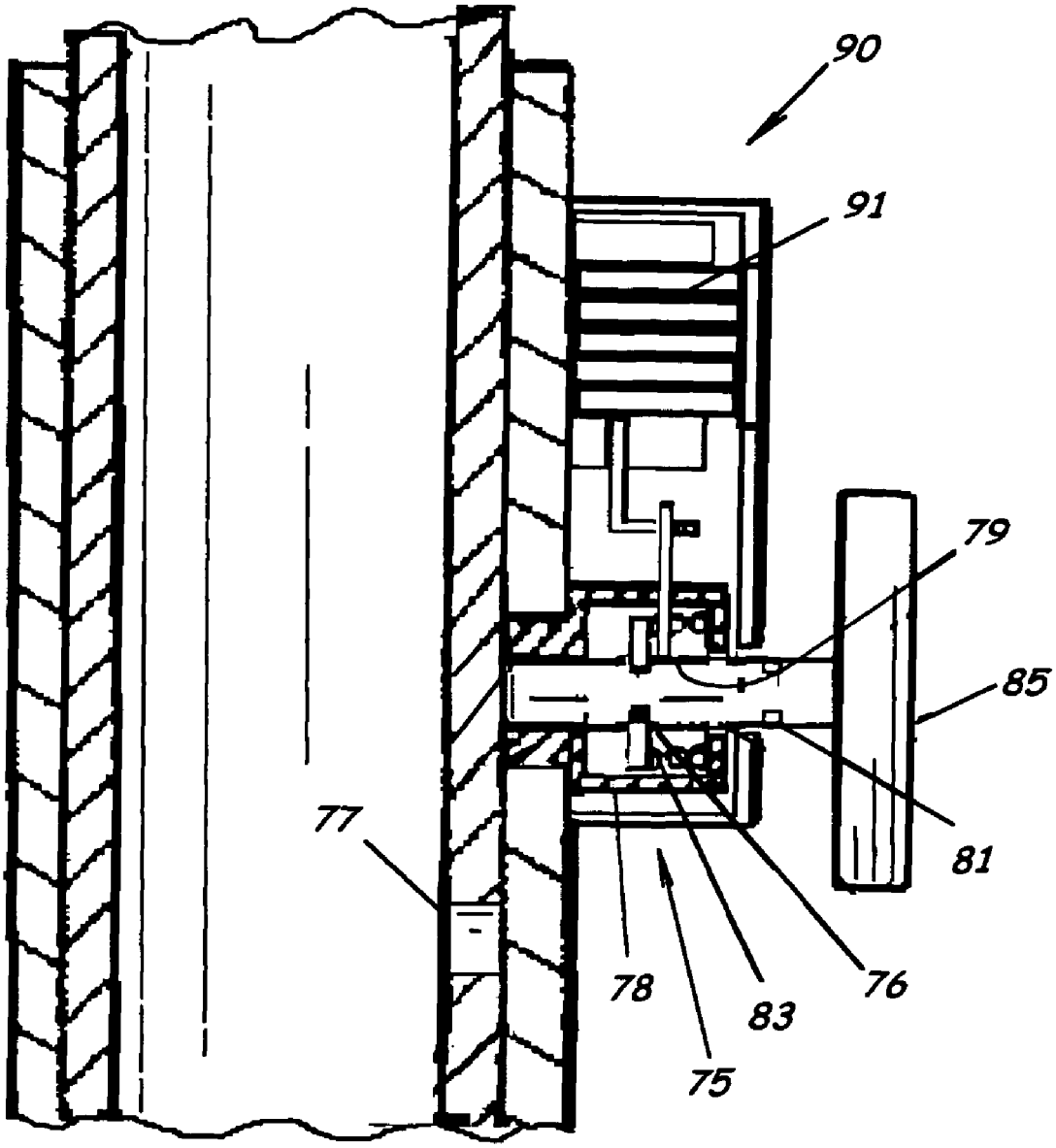
FIG. 5 is a fragmentary sectional view of a circuit interrupting apparatus according to an embodiment of the present invention.
Figure 6:
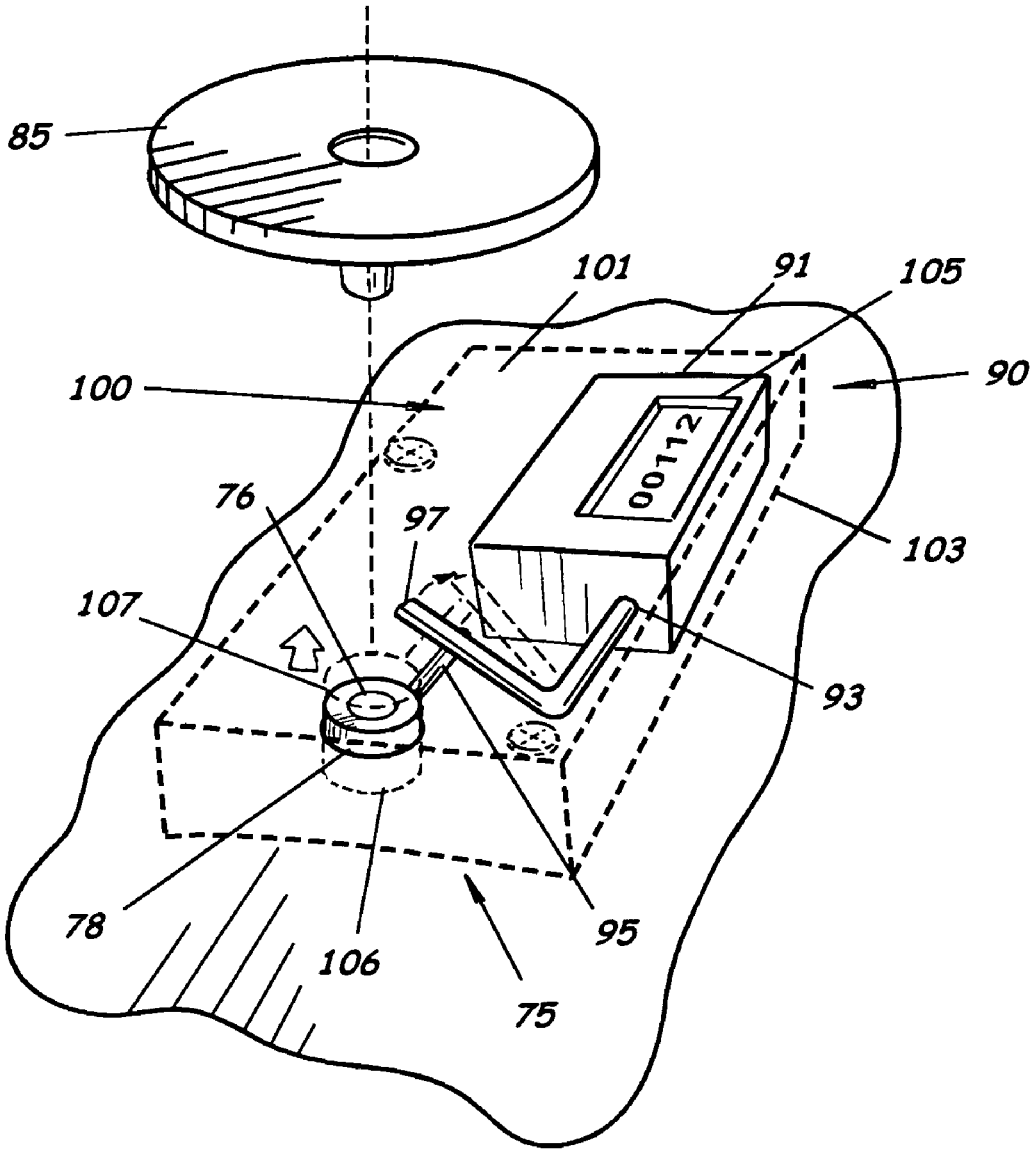
FIG. 6 is an exploded perspective view of an operation counter of a circuit interrupting apparatus according to an embodiment of the present invention.

As shown in FIGS. 4–6, the circuit interrupting apparatus 32 also includes a reset plunger assembly 75 which can form part of an operation counter assembly 90 (described later). The reset plunger assembly 75 includes a reset plunger 76 and is connected to a medial portion of the main body of the main housing 34. The reset plunger assembly 75 can include a reset plunger extension 78 connected within and extending outwardly from an opening in the main body of housing 34. The reset plunger extension 78 has a reset plunger conduit 79 and can have an annular seal 81 positioned within the reset plunger conduit 79 for sealing the reset plunger 76 within the reset plunger conduit 79 to prevent contamination of the circuit interrupting apparatus 32 from contaminants external to the main body outer surface 33 of the main housing 34. The reset plunger assembly 75 further includes a spring 83 to bias the reset plunger 76 in an inward direction. A plunger ring knob 85 is connected to an outward end of the reset plunger 76 to allow the operator to reset the circuit interrupting apparatus 32.

The reset plunger 76 is adapted to extend at least portions of the reset plunger 76 through the reset plunger opening 77 in the medial portion of the main body of sleeve 36 when in a non-reset and biased inward lock position to releasably lock the sleeve 36 in the extended position. This feature allows the circuit interrupting apparatus 32 to obtain and maintain an electrical clearance between the ring engaging terminal 40 and the hook engaging terminal 68 when the ring engaging terminal 40 and the hook engaging terminal 68 are connected to the circuit isolating device 10 and when the main body of sleeve 36 is positioned in the extended position. The sleeve 36 will be locked in its extended position, until the release plunger 76 is manually released (pulled), which permits the spring 38 to return the sleeve 36 to its retracted position. The reset plunger 76 is further adapted to reset outward responsive to outwardly biased pressure by the user and outward pressure from the main body outer surface 37 of sleeve 36 when in an at least partially retracted position.

As shown in FIGS. 4–6, the circuit interrupting apparatus 32 also includes an operation counter assembly 90. The operation counter assembly 90 includes the reset plunger assembly 75 such as that described above, and an operation counter 91 connected to the reset plunger 76 and is responsive to movement of the reset plunger 76. The operation counter 91 is positioned to count a number of circuit interrupting operations of the circuit interrupting apparatus 32 and includes a counter and display device. The operations counter assembly 90 further includes an operation counter housing 100 having a front 101, a back 103, and at least one side positioned therebetween and containing the operation counter 91 within. The display 105 of the operation counter can be viewed through either a transparent or cutaway portion of the front 101 of the operation counter housing 100. The back 103 of the operation counter housing 100 has an operation counter housing back opening 106 positioned in a surrounding relationship around outer surface peripheries of the reset plunger extension 78 to prevent contamination of the operation counter 91 and display 105 from contaminants external to the operation counter housing 100. The front 101 of the operation counter housing 100 has an operation counter housing front opening 107 positioned in a surrounding relationship around reset plunger extension 78 also to prevent contamination of the operation counter 91 and display 105 from contaminants external to the operation counter housing 100 and to allow passage of the reset plunger 76. The operations counter housing 100 can be fastened to the main body outer surface 33 of the sleeve 36 of the circuit interrupting apparatus 32 by fasteners or connectors well known by those skilled in the art. Note, though described with respect to circuit interrupting apparatus 32, relatively minor adjustments to the main housing can be made to provide fasteners or connectors as known by those skilled in the art to retrofit the operations counter housing 100 to various pre-existing circuit interrupting apparatus. For example, small recesses can be made in the main housing body of the main housing to receive fasteners or can be connected with an adhesive or other similar connection methodology.

In an embodiment of the present invention, the operation counter 91 comprises a mechanical counter and either mechanical or electronic display device and a rotational counter incrementor 93 to increment a count of the operation counter 91. Use of mechanical counters around high-voltage power lines can be beneficial as they are not affected by electrical currents that can be generated in conductors moving with respect to electromagnetic fields generated by the high-voltage powerlines. The operation counter assembly 90 further includes a roll pin 95 connected to the reset plunger 76 and a click-over lever 97 connected between the rotational counter incrementor 93 and the roll pin 95. The operation counter 91 is responsive to longitudinal movement of the reset plunger 76 preferably in the outward direction to reset the operation counter 91 to enable the operation counter 91 to increment the count and responsive to longitudinal movement in an inward direction to actually increment the count displayed by the operation counter 91 when such longitudinal movement occurs. The reverse, however, can also be true. Advantageously, the operation counter 91 can also be configured such that it is non-resettable by a field operator in order to prevent inadvertent reset of the operation count. Thus, the count displayed can be a continuous running total spanning the lifetime of the circuit interrupting apparatus 32, if so configured.

The reset plunger 76 is preferably spring-loaded so that it pushes against the outer body surface 37 of sleeve 36 when the sleeve 36 is in the retracted position (FIG. 3) and during transit into the extended position. Once the sleeve 36 is in the fully extended position (FIG. 4) the reset plunger 76 enters into opening 77 in the main body of the sleeve 36. This locks the circuit interrupting apparatus 32 in the open or extended position and thus allows the reset plunger 76 to travel inward further than when it is resting against the outer body surface 37 of the sleeve 36. This additional travel of the reset plunger 76 is sufficient to click over the operation counter 91. When the operator pulls on the plunger ring knob 85, the reset plunger 76 releases sleeve 36 and the spring 38 retracts the sleeve 36 within the housing 34 causing the opening 77 in the main body of sleeve 36 to no longer align with reset plunger 76, thus maintaining the reset plunger 76 in an outward position.

Figure 7:
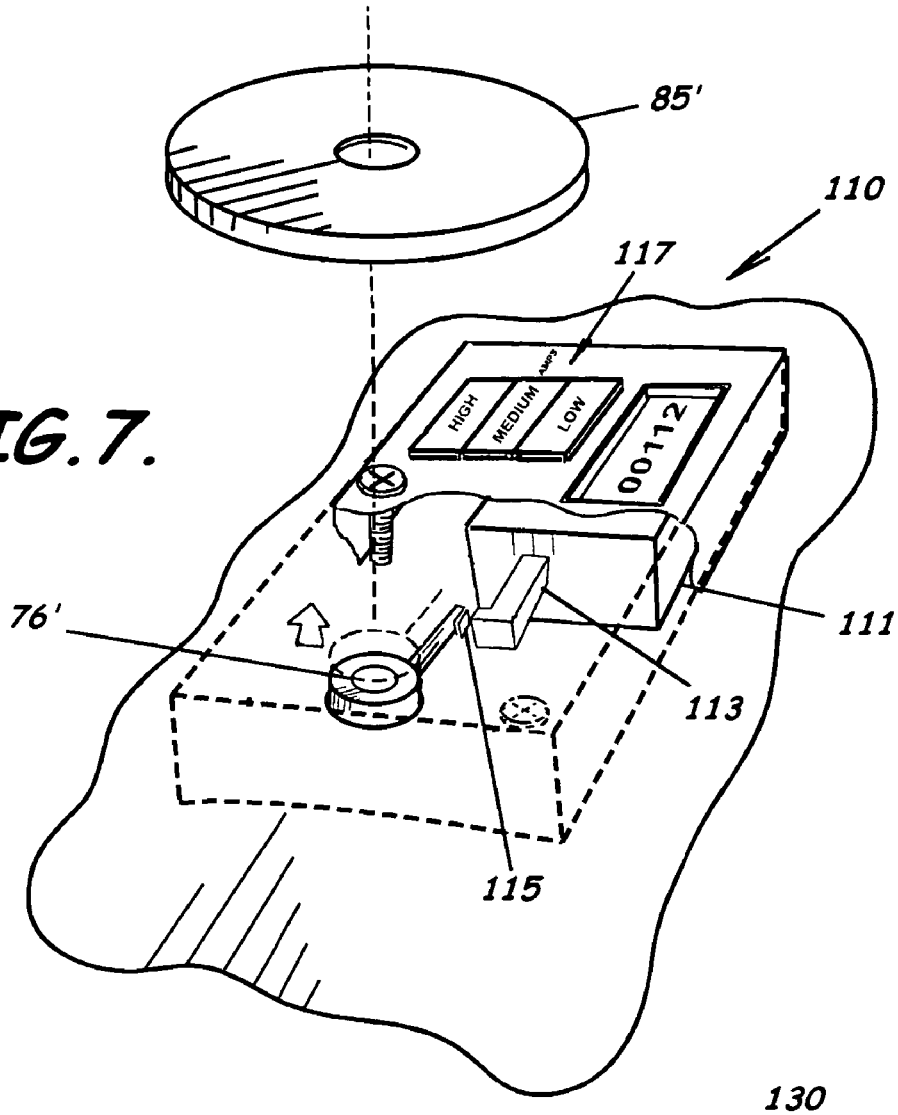
FIG. 7 is an exploded perspective view of an operation counter, according to an alternative embodiment of the present invention.

An alternative embodiment of the present invention, as shown in FIG. 7, provides an operation counter assembly 110 which includes an operation counter 111. The operation counter 111 includes an electrical counter and display device and includes a counter incrementor switch 113 to increment a count of the operation counter 111. The operation counter assembly 110 further includes means for engaging the counter incrementor switch 113 responsive to movement of the reset plunger 76' in a longitudinal direction and positioned to increment the operation counter 111 when such movement occurs. The means for engaging the counter incrementor switch 113 are well known to those skilled in the art and can include mechanical, electrical, and magnetic means. For example, the rotational counter incrementor and roll pin described above can be used. The incrementor switch 113 can be activated either by movement or actual contact with either the reset plunger 76' or a device or connector such as roll pin 95 connected to the reset plunger. Additionally, the means for engaging the counter incrementor switch 113, as illustrated in FIG. 7, can include the counter incrementor switch 113 being a magnetically activated counter incrementor switch and a magnet 115 positioned on or in the reset plunger 76' or in an extension pin, as illustrated. In the configuration where the magnet 115 is used, the magnet 115 can be longitudinally positioned such that inward directed movement of the reset plunger 76' causes either passage of the magnet 115 across or adjacent the counter incrementor switch 113 or loss of a magnetic field due to movement of the magnet 115 away from the counter incrementor switch 113. This change in magnetic flux causes the counter incrementor switch 113 to either close or open to indicate to the operation counter 111 that an action has been performed which requires incrementing the count.

In an embodiment of the present invention, the operations counter assembly 110 can also include a selection switch panel 117 having a plurality of selection switches for selecting a plurality of categories of amperage range of values most closely associated with the circuit isolating device 10. The operation counter 111 separately records the count and associates the count with a category selected from the plurality of categories and can track and display a number of counts associated with each of the plurality of categories along with the total number of operation counts. For example, the operation counter 111 can have user selectable switches or a single user selectable switch to select a high, medium, and/or low amperage servicing operation. Actuation of the reset plunger 76' in view of the category selected can result in incrementing the selected category along with the total operation count.

Figure 8:
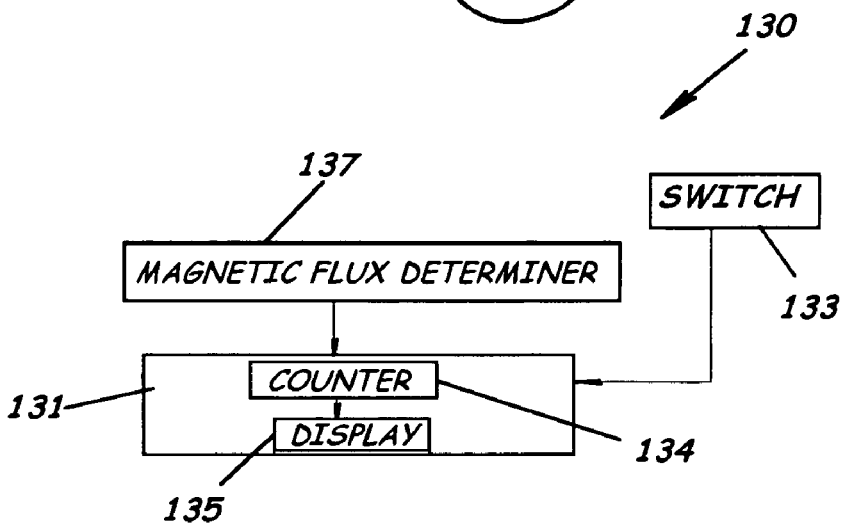
FIG. 8 is a schematic diagram of an operation counter according to another alternative embodiment of the present invention.

In another embodiment of the present invention, as perhaps best shown in FIG. 8, an operation counter assembly 130 includes an operation counter 131 having a counter 134 and display device 135, a counter incrementor switch 133 electrically connected to the counter 134, and magnetic flux detector or determiner 137 for measuring the strength of the magnetic flux, also electrically connected to the counter 134, and positioned to determine a categorical type of usage of the circuit interrupting apparatus 32" among a plurality of categories. In this embodiment of the present invention, the operation counter 131 separately records a number of counts associated with each of the categorical type of usages. This feature allows for scheduling maintenance dependent upon not only the total number of operation counts but also on the level of fatigue corresponding with the category of amperage of the circuit interrupted. Magnetic flux determiners for measuring magnetic flux in a conductor are well known to those skilled in the art and can include, for example, a magnetic field sensor such as Hall effect sensor to detect the level of magnetic flux based upon the level of current passing through the shunt circuit assembly 74. A magnetic field generator (not shown) to form a magnetic field perpendicular to a conductor within the shunt circuit assembly 74, if required, is also well known to those skilled in the art. The magnetic flux sensed prior to interruption of the current flow or the level of flux change due to the current change coinciding with creating or interrupting the circuit can be detected by the magnetic flux determiner 137 and used by the counter 134 to associate an operation count with one of a plurality of categories. The total operation counts and operation counts of the various categories can be separately stored by the counter 134 and displayed on the display device 135.

Advantageously, also provided are methods for forming and using a circuit interrupting apparatus 32 including an operation counter such as operation counter 91 or 111. As perhaps best shown in FIGS. 3–7, the method of forming the circuit interrupting apparatus 32 includes providing an operation counter assembly such as operation counter assembly 90 or 110 including an operation counter housing 100 containing an operation counter and display and an operation counter actuating switch 93. The operation counter housing 100 has a back side opening 106 adapted to interface with a reset plunger 76 protruding through a main body outer surface 33 of a main housing 34 of the circuit interrupting apparatus 32 and an operation counter housing front side opening 107 for allowing passage of the reset plunger 76 through the operation counter housing 100. The method also includes installing an operation counter actuating switch actuator to the reset plunger 76 such as roll pin 95 or magnet 115, and fastening the operation counter housing 100 to the main body of housing 34 of the circuit interrupting apparatus 32 to provide actuation of the counter.

As perhaps best shown in FIGS. 1–2, an embodiment of the present invention includes the method of using a circuit interrupting apparatus 32 having an operation counter 91 or 111 on a circuit isolating device 10. Initially, and as perhaps best shown in FIG. 1, a circuit interrupting apparatus 32 such as that described above is lifted on the line pole 63 to a position adjacent the isolating device 10. The operator then aligns the ring engaging terminal 40 with the ring-like conducting part 20 of the isolating device, and then moves the circuit interrupting apparatus 32 laterally in a continuous thrust so that the terminal 40 initially enters the ring-like conducting part 20. With continuing lateral movement, the terminal 40 guides the circuit interrupting apparatus 32 so that the hook engaging terminal 68 properly and automatically engages the hook-like conducting part 25. The operative interconnection of the two devices is then complete.

As perhaps best shown in FIG. 2, next, the operator pulls downwardly on the line pole 63, causing the ring-like conducting part 20 to move forwardly and separate the upper current carrying member 17 from the contact member 18. This separation breaks the circuit through the device 10 but the circuit remains closed by reason of the shunting circuit 74 through the apparatus 32. Also, the pair of discs 54 in the mid portion of the terminal 40 acts to maintain its connection to the ring-like conducting part 20 during this downward movement. The two discs 54 also provide the user with a locating method which is positive and leaves no doubt the circuit interrupting apparatus 32 is in the proper position for operation.

Continued downward movement of the line pole 63 causes the sleeve 36 to axially extend from the main housing 34 against the biasing force of the spring 38, and by reason of the arcuate movement of the terminal 40, the main housing 34 will pivot away from the connector arm 60 about the axis of the pivot pin 56. Reset plunger 76, positioned to extend through a reset plunger opening 77 in a medial portion of a main body of sleeve 36, slides down the main body outer surface 37 of sleeve 36 during such extension and until reaching reset plunger opening 77. When the sleeve 36 reaches this predetermined extension position, the spring 83 extends the reset plunger 76 through reset plunger opening 77, locking sleeve 36 in the extended position and incrementing the operation counter 91, 111. Correspondingly, the shunting circuit 74 is interrupted inside the housing 36 so as to protectively contain the resulting arc.

Note, the shuttle 44, if installed, will normally remain locked in the upper position due to the pin 48, as shown in FIG. 3. Where larger isolating devices 10 are to be serviced, the shuttle 44 is freed by the removal of the pin 48. The shuttle 44 thus is initially held at its upper position by the spring 45 as shown in FIG. 3, but it slides downwardly during the circuit interrupting operation and is locked in the lowered position by the pin 52 automatically entering the opening 46 as shown in FIG. 4. In this regard, the strength of the spring 45 engaging the shuttle 44, and the strength of the spring 38 engaging the sleeve 36 are coordinated in order to permit the shuttle 44 to slide concurrently with the extension of the sleeve 36.

With the circuit interruption complete, the user releases the circuit interrupting apparatus 32 from the isolating device 10 and lowers it to the ground. The user then grasps or pulls on the plunger ring knob 85 which, absent the downward pull provided by the operator to extend the sleeve 36 from within the main body of main housing 34, allows the spring 38 to retract the sleeve 36 within the main housing 34. This retraction causes the reset plunger opening 77 in the main body of sleeve 36 to no longer align with the reset plunger 76, thus maintaining the reset plunger 76 in an outward position. If the shuttle 44 was configured such that pin 52 is engaged within opening 46, the user also retracts pin 52 to allow shuttle 44 to be repositioned by spring 45 in the top position.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification and as defined in the attached claims. For example, the described electrical counter can be mechanically actuated or the described mechanical counter can have a plurality of displays.

What is claimed is:

1. A portable circuit interrupting apparatus for use in association with a circuit isolating device comprising:

a main housing having a main housing body including a main housing body outer surface and a longitudinal axis;

a sleeve including a main sleeve body having a main sleeve body outer surface and coaxially mounted within the main housing so as to be slidable between an extended position and a retracted position, a spring assembly for biasing the main sleeve body from between the extended position toward the retracted position, and a reset plunger opening positioned in a medial portion of the main sleeve body;

a shunting circuit assembly having a ring engaging terminal adapted to electrically connect to a ring-like conducting part of a circuit isolating device and a hook engaging terminal adapted to electrically connect to a hook-like conducting part of a circuit isolating device, a shunting circuit segment connected between the ring engaging terminal and the hook engaging terminal and positioned within the housing and sleeve to interrupt an electrical connection between the ring-like conducting part and hook-like conducting part responsive to movement of the sleeve from the retracted position to the extended position;

a reset plunger assembly including a reset plunger and connected to a medial portion of the main housing body, adapted to extend at least portions of the reset plunger through the reset plunger opening in the medial portion of the main sleeve body when in a non-reset and biased inward lock position to releasably lock the sleeve in the extended position so as to obtain and maintain an electrical clearance between the ring engaging terminal and the hook engaging terminal when the ring engaging terminal end the hook engaging terminal engage a circuit isolating device and when the main sleeve body is positioned in the extended position, and adapted to reset outwardly responsive to outwardly biased pressure by a user and outward pressure from the main sleeve outer surface when the main sleeve body is in an at least partially retracted position; and an operation counter assembly positioned at the medial portion of the main housing body and including an operation counter connected to the reset plunger assembly and positioned to count a number of circuit interrupting operations of the circuit interrupting apparatus, responsive to movement of the reset plunger.

2. The portable circuit interrupting apparatus as defined in claim 1, wherein the operation counter includes a rotational counter incrementor to increment a count of the operation counter, and wherein the operation counter assembly further includes a roll pin connected to the reset plunger and a click-over lever connected between the rotational counter incrementor and the roll pin and responsive to longitudinal movement of the reset plunger in a first direction to reset the counter to enable the operation counter to increment and responsive to longitudinal movement in a second direction to increment the operation counter when such movement occurs.

3. The portable circuit interrupting apparatus as defined in claim 1, wherein the operation counter includes a counter incrementor switch to increment a count of the operation counter, and wherein the portable circuit interrupting apparatus further includes means for engaging the counter incrementor switch positioned to increment the operation counter responsive to movement of the reset plunger in a longitudinal direction.

4. A portable circuit interrupting apparatus for use in association with a circuit isolating device comprising:

a main housing having a main housing body including a main housing body outer surface and a longitudinal axis;

a sleeve including a main sleeve body having a main sleeve body outer surface and coaxially mounted within the main housing so as to be slidable between an extended position and a retracted position, a spring assembly for biasing the main sleeve body from between the extended position toward the refracted position, and a reset plunger opening positioned in a medial portion of the main sleeve body;

a shunting circuit assembly having a ring engaging terminal adapted to electrically connect to a ring-like conducting part of a circuit isolating device and a hook engaging terminal adapted to electrically connect to a hook-like conducting part of a circuit isolating device, a shunting circuit segment connected between the ring engaging terminal and the hook engaging terminal and positioned within the housing and sleeve to interrupt an electrical connection between the ring-like conducting part and hook-like conducting part responsive to movement of the sleeve from the retracted position to the extended position;

a reset plunger assembly including a reset plunger and connected to a medial portion of the main housing body, adapted to extend at least portions of the reset plunger through the reset plunger opening in the medial portion of the main sleeve body when in a non-reset and biased inward lock position to releasably lock the sleeve in the extended position so as to obtain and maintain an electrical clearance between the ring engaging terminal and the hook engaging terminal when the ring engaging terminal and the hook engaging terminal engage a circuit isolating device and when the main sleeve body is positioned in the extended position, and adapted to reset outwardly responsive to outwardly biased pressure by a user and outward pressure from the main sleeve outer surface when the main sleeve body is in an at least partially retracted position; and an operation counter assembly including an operation counter connected to the reset plunger and positioned to count a number of circuit interrupting operations of the circuit interrupting apparatus, responsive to movement of the reset plungers and having:

a magnet positioned adjacent a portion of the reset plunger, and a counter incrementor switch including a magnetic switch positioned to increment a count of the operation counter responsive to positioning of the magnet adjacent the magnetic switch resulting from longitudinal movement of the reset plunger.

5. A portable circuit interrupting apparatus for use in association with a circuit isolating device comprising:

a main housing having a main housing body including a main housing body outer surface and a longitudinal axis;

a sleeve including a main sleeve body having a main sleeve body outer surface and coaxially mounted within the main housing so as to be slidable between an extended position and a retracted position, a spring assembly for biasing the main sleeve body from between the extended position toward the retracted position, and a reset plunger opening positioned in a medial portion of the main sleeve body;

a shunting circuit assembly having a ring engaging terminal adapted to electrically connect to a ring-like conducting part of a circuit isolating device and a hook engaging terminal adapted to electrically connect to a book-like conducting part of a circuit isolating device, a shunting circuit segment connected between the ring engaging terminal and the hook engaging terminal and positioned within the housing and sleeve to interrupt an electrical connection between the ring-like conducting part and hook-like conducting part responsive to movement of the sleeve from the retracted position to the extended position;

a reset plunger assembly including a reset plunger and connected to a medial portion of the main housing body, adapted to extend at least portions of the reset plunger through the reset plunger opening in the medial portion of the main sleeve body when in a non-reset and biased inward lock position to releasably lock the sleeve in the extended position so as to obtain and maintain an electrical clearance between the ring engaging terminal and the hook engaging terminal when the ring engaging terminal and the hook engaging terminal engage a circuit isolating device and when the main sleeve body is positioned in the extended position, and adapted to reset outwardly responsive to outwardly biased pressure by a user and outward pressure from the main sleeve outer surface when the main sleeve body is in a at least partially refracted position;

an operation counter assembly including a operation counter connected to the reset plunger, positioned to count a number of circuit interrupting operations of the circuit interrupting apparatus, responsive to movement of the reset plunger, and positioned to record a number of counts associated with a categorical type of usage of the circuit interrupting apparatus, and having:

a counter incrementor switch to increment a count of the operation counter, responsive to movement of the reset plunger in a longitudinal direction, means for engaging the counter incrementor switch, and a magnetic flux determiner for measuring the strength of the magnetic flux to determine the categorical type of usage of the circuit interrupting apparatus.

6. The portable circuit interrupting apparatus as defined in claim 3, wherein the operation counter assembly further includes a selection switch for selecting a plurality of categories of amperage range of values most closely associated with the circuit isolating device, and wherein the operation counter separately records the count and associates the count with a category selected from the plurality of categories and tracks a number of counts associated with each of the plurality of categories and displays the number of counts associated with the category so selected.

7. The portable circuit interrupting apparatus as defined in claim 1, wherein the main housing body includes a main housing body opening, and wherein the reset plunger assembly further includes a reset plunger extension connected within and extending out from the main housing body opening and having a reset plunger conduit, and a spring to bias the reset plunger in an inwardly direction so that the reset plunger engages the reset plunger opening when the main sleeve body is extended and the reset plunger opening is adjacent the reset plunger.

8. The portable circuit interrupting apparatus as defined in claim 7, wherein the operation counter assembly further includes an operation counter housing having an operation counter housing front, an operation counter housing back, and at least one operation counter housing side positioned therebetween and containing the operation counter therein, the operation counter housing back having an operation counter housing back opening positioned in a surrounding relationship around outer surface peripheries of the reset plunger extension to prevent contamination of the operation counter from contaminants external to the operation counter housing, the operation counter housing front having an operation counter housing front opening positioned in a surrounding relationship around outer surface peripheries of the reset plunger extending therethrough.

9. The portable circuit interrupting apparatus as defined in claim 1, wherein the operation counter is non-resettable by a field operator in order to prevent inadvertent reset of the operation count.

10. The portable circuit interrupting apparatus as defined in claim 1, wherein the operation counter assembly includes a fastener to fasten the operation counter housing to the medial portion of the main housing body of the circuit interrupting apparatus.

11. An operation counter assembly positioned on a circuit interrupting apparatus for use in association with a circuit isolating device, the circuit interrupting apparatus having a main housing including a main housing body having a main housing body outer surface and a sleeve including a main sleeve body having a main sleeve body outer surface and coaxially mounted within the main housing, the operation counter assembly comprising:

a reset plunger assembly including a reset plunger adapted to extend through a portion of the main housing body outer surface of the circuit interrupting device, at least portions of the reset plunger adapted to extend through a reset plunger opening in a medial portion of the main sleeve body when in a non-reset and biased inward lock position to releasably lock the main sleeve body in an extended position so as to obtain and maintain an electrical clearance between a ring engaging terminal and a hook engaging terminal of the circuit interrupting device when the ring engaging terminal and the hook engaging terminal engage the circuit isolating device and when the main sleeve body is positioned in the extended position, and adapted to reset outwardly responsive to outwardly biased pressure by a user and outward pressure from the main sleeve outer surface when main sleeve body is in an at least partially retracted position; and an operation counter positioned at a medial portion of the main housing body and connected to the reset plunger assembly and positioned to count and display a number of circuit interrupting operations of the circuit interrupting apparatus, responsive to movement of the reset plunger.

12. The operation counter assembly as defined in claim 11, wherein the operation counter includes a rotational counter incrementor to increment a count of the operation counter, and wherein the operation counter assembly further includes a roll pin adapted to be connected to the reset plunger and a click-over lever connected between the rotational counter incrementor and the roll pin and responsive to longitudinal movement of the reset plunger in a first direction to reset the counter to enable the operation counter to increment and responsive to longitudinal movement in a second direction to increment the operation counter when such movement occurs.

13. The operation counter assembly as defined in claim 11, wherein the operation counter includes a counter incrementor switch to increment a count of the operation counter, and wherein the operation counter assembly further includes means for engaging the counter incrementor switch positioned to increment the operation counter responsive to movement of the reset plunger in a longitudinal direction.

14. The operation counter assembly as defined in claim 13, wherein the means for engaging the counter incrementor switch includes a magnet positioned adjacent a portion of the reset plunger, and wherein the counter incrementor switch includes a magnetic switch responsive to positioning of the magnet adjacent the magnetic switch resulting from longitudinal movement of the reset plunger.

15. The operation counter assembly as defined in claim 13, wherein the operation counter assembly includes a magnetic flux determiner for measuring the strength of the magnetic flux to determine a categorical type of usage of the circuit interrupting apparatus, and wherein the operation counter separately records a number of counts associated with each of the categorical type of usages.

16. The operation counter assembly as defined in claim 13, wherein the operation counter assembly includes a selection switch for selecting a plurality of categories of amperage range of values most closely associated with the circuit isolating device, and wherein the operation counter separately records the count and associates the count with a category selected from the plurality of categories and tracks a number of counts associated with each of the plurality of categories and displays the number of counts associated with the category so selected.

17. The operation counter assembly as defined in claim 11, wherein the main housing body of the circuit interrupting apparatus includes a main housing body opening, and wherein the reset plunger assembly father includes a reset plunger extension adapted to extend out from the main housing body opening and having a reset plunger conduit and a spring to bias the reset plunger in an inwardly direction so that the reset plunger engages the reset plunger opening when the main sleeve body is extended and the reset plunger opening is adjacent the reset plunger.

18. The operation counter assembly as defined in claim 17, further comprising an operation counter housing having an operation counter housing front, an operation counter housing back, and at least one operation counter housing side positioned therebetween and containing the operation counter therein, the operation counter housing back having an operation counter housing back opening positioned in a surrounding relationship around outer surface peripheries of the reset plunger extension to prevent contamination of the operation counter from contaminants external to the operation counter housing, the operation counter housing front having an operation counter housing front opening positioned in a surrounding relationship around outer surface peripheries of the reset plunger extending therethrough.

19. The operation counter assembly as defined in claim 11, wherein the operation counter is non-resettable by a field operator in order to prevent inadvertent reset of the operation count.

20. The operation counter assembly as defined in claim 11, further comprising a fastener to fasten the operation counter housing to a medial portion of the main housing body of the circuit interrupting apparatus.

21. A method of forming a circuit interrupting apparatus adapted to count a number of circuit interrupting operations, the method comprising the steps of:

providing an operation counter to be positioned at a medial portion of a main housing body of the circuit interrupting apparatus and including an operation counter housing an operation counter and an operation counter actuating switch and having an operation counter housing back side opening adapted to interface with a reset plunger assembly including a reset plunger extending through a main housing body outer surface of the main housing body of the circuit interrupting apparatus and an operation counter housing front side opening for allowing passage of the reset plunger through the operation counter housing;

connecting an operation counter actuating switch actuator to the reset plunger; and fastening the operation counter housing at the medial body portion of the main housing body of the circuit interrupting apparatus separate and spaced apart from an exhaust control assembly of the circuit interrupting apparatus.

22. A method of using a circuit interrupting apparatus on a circuit isolating device, the method comprising the steps of:

positioning a reset plunger to extend through a reset plunger opening in a portion of a main sleeve body positioned within a medial portion of a main housing body of the circuit interrupting apparatus when the main sleeve body is positioned in an extended position;

engaging a hook-like conducting part of the circuit isolating device with a hook engaging terminal of the circuit interrupting apparatus adapted to electrically connect to the hook-like conducting part;

engaging a ring like conducting part of the circuit isolating device with a ring engaging terminal of the circuit interrupting apparatus adapted to electrically connect to the ring-like conducting part of the circuit isolating device, the ring like conducting part being relatively moveable between a contacting position to establish a closed circuit through the circuit isolating device and a separated position to establish an open circuit through the circuit isolating device and to extend the main sleeve body from within the main housing body of the circuit interrupting apparatus;

extending at least portions of the reset plunger through the reset plunger opening in the medial portion of the main sleeve body responsive to positioning of the main sleeve body in the extended position; and incrementing an operation counter, positioned at a medial portion of the main body housing of the circuit interrupting apparatus separate and spaced apart from an exhaust control assembly of the circuit interrupting apparatus, upon and directly in response to at least one of extension and retraction of the at least portions of the reset plunger through the medial portion of the main sleeve body.

23. A portable circuit interrupting apparatus for use in association with a circuit isolating device comprising:

a main housing including a main housing body outer surface;

a sleeve including a main sleeve body having a main sleeve body outer surface and coaxially mounted within the main housing;

a reset plunger adapted to extend through a medial portion of the main housing body outer surface and into a reset plunger opening in a portion of the main sleeve body, when in a non-reset and biased inward lock position to releasably lock the main sleeve body in an extended position, and adapted to reset outwardly responsive to outward pressure from the main sleeve body outer surface when the main sleeve body is in an at least partially retracted position; and an operation counter assembly associated with the reset plunger, positioned at the medial portion of the main housing body, and positioned, responsive to the movement of the reset plunger, to count a number of circuit interrupting operations of the circuit interrupting apparatus.

24. The portable circuit interrupting apparatus as defined in claim 23, wherein the operation counter assembly is interfaced with the reset plunger, wherein the operation counter assembly includes an operation counter, and wherein the operation counter assembly includes a counter incrementor switch positioned to increment a count of the operation counter responsive to extension of at least portions of the reset plunger through an opening in the main sleeve body.

25. The portable circuit interrupting apparatus as defined in claim 23, wherein the main housing body includes a main housing body opening, and wherein the portable circuit interrupting apparatus further comprises:

a reset plunger assembly including a reset plunger extension connected within and extending out from the main housing body opening and having a reset plunger conduit, and a spring to bias the reset plunger in an inwardly direction so that the reset plunger engages the reset plunger opening when the main sleeve body is extended and the reset plunger opening is adjacent the reset plunger; and an operation counter housing having an operation counter housing front, an operation counter housing back, and at least one operation counter housing side positioned therebetween and containing the operation counter therein, the operation counter housing bank having an operation counter housing back opening positioned in a surrounding relationship around outer surface peripheries of the reset plunger extension to prevent contamination of the operation counter from contaminants external to the operation counter housing, the operation counter housing front having an operation counter housing front opening, the reset plunger extending therethrough.

26. An operation counter assembly positioned on a circuit interrupting apparatus for use in association with a circuit isolating device, the circuit interrupting apparatus having a main housing including the main housing body having a main housing body outer surface, a sleeve including a main sleeve body coaxially mounted within the main housing body, a reset plunger adapted to extend through the main housing body and into a preselected portion of the main sleeve body to releasably lock the main sleeve body in an extended position, and an exhaust control assembly positioned to release exhaust gases during circuit interruption, the operation counter assembly comprising:

an operation counter a positioned at a medial portion of the main housing body at least partially external to the main housing body outer surface, separate and spaced apart from the exhaust control assembly to avoid the exhaust gases, to thereby extend a service life of the operation counter, and adapted to be positioned to count a number of circuit interrupting operations of the circuit interrupting apparatus indicated by substantially full operational extension of the main sleeve body.

27. The operation counter assembly as defined in claim 26, wherein the operation counter is adapted to increment, responsive to longitudinal extension of at least portions of the reset plunger trough an opening in the main sleeve body.

28. An operation counter assembly positioned on a circuit interrupting apparatus for use in association with a circuit isolating device, the circuit interrupting apparatus comprising a main housing including a main housing body having a main housing body outer surface and an exhaust control assembly connected to the main housing body and positioned to release exhaust gases during circuit interruption, the operation counter assembly comprising:

a plunger extending through a medial portion of the main housing body; and an operation counter positioned at the medial portion of the main housing body substantially external to the main housing body outer surface, and separate and spaced apart from the exhaust control assembly to avoid the exhaust gases, to thereby extend a service life of the operation counter, and positioned to count a number of circuit interrupting operations of the circuit interrupting apparatus, responsive to longitudinal movement of the plunger.

29. An operation counter assembly positioned on a circuit interrupting apparatus for use in association with a circuit isolating device, the circuit interrupting apparatus having a main housing including a main housing body, a sleeve including a main sleeve body coaxially positioned within the main housing body, a reset plunger positioned to extend longitudinally through an opening in the main housing body and into a preselected portion of the main sleeve body to releasably lock the main sleeve body in an extended and locked position when performing a circuit-interrupting operation, and positioned to reset outwardly responsive to outward pressure from the main sleeve outer surface when the main sleeve body is in an at least partially retracted position to allow the main sleeve body to be retracted and the circuit interrupting apparatus to be readied for a next circuit-interrupting operation, the operation counter assembly including an operation counter positioned at a medial portion of the main housing body, interfaced with the reset plunger, and positioned to count a number of circuit interrupting operations of the circuit interrupting apparatus, responsive to longitudinal movement of the reset plunger during a circuit-interrupting operation.

30. The operation counter assembly as defined in claim 29, wherein the operation counter is adapted to increment, responsive to longitudinal extension of at least portions of the reset plunger through an opening in the main sleeve body; and wherein the operation counter is adapted to reset for a next count, responsive to manual extraction of the reset plunger from the opening in the main sleeve body by a user.

* * * * *